US005713517A

United States Patent [19]

Loison

[11] Patent Number: 5,713,517

[45] Date of Patent: Feb. 3, 1998

[54] SOCK FOR A BALLASTLESS RAIL TRACK TIE

[75] Inventor: Claude Loison, Onnaing, France

[73] Assignee: Allevard, Saint Cloud, France

[21] Appl. No.: 744,480

[22] Filed: Nov. 6, 1996

[30] Foreign Application Priority Data

Sep. 11, 1995 [FR] France ..... 95 13260

[51] Int. Cl.[6] ..... F01B 2/00

[52] U.S. Cl. ..... 238/2; 238/84

[58] Field of Search ..... 238/1, 2, 6, 7, 238/29, 83, 84, 107, 283

[56] References Cited

U.S. PATENT DOCUMENTS

| | | | |
|---|---|---|---|
| 859,330 | 7/1907 | Overland | 238/2 |
| 3,289,941 | 12/1966 | Sonneville | 238/116 |
| 4,266,719 | 5/1981 | Ortwein et al. | 238/7 |
| 4,356,968 | 11/1982 | Harmsen | 238/1 |
| 4,489,884 | 12/1984 | Harmsen | 238/83 |
| 4,609,144 | 9/1986 | Harmsen . | |
| 4,652,495 | 3/1987 | Sato et al. | 238/84 |

FOREIGN PATENT DOCUMENTS

| | | | |
|---|---|---|---|
| 2648489 | 12/1990 | France . | |
| 11504 | 1/1977 | Japan | 238/2 |

*Primary Examiner*—S. Joseph Morano

*Attorney, Agent, or Firm*—Dennison, Meserole, Pollack & Scheiner

[57] ABSTRACT

A sock for a tie of ballastless rail track that is to be held in a bed of concrete, the sock comprising firstly an elastically deformable case receiving the tie whose bottom edge is chamfered, and secondly a pad lying beneath the tie in the bottom of the case, wherein the bottom portion of the case includes, in its inside wall, recesses guaranteeing compression flexibility thereto even after the wall has been deformed under the effect of hydrostatic pressure from the concrete bed.

7 Claims, 4 Drawing Sheets

SOCK FOR A BALLASTLESS RAIL TRACK TIE

The present invention relates to a sock for a tie for ballastless rail track. Ballastless tracks are used, in particular, in tunnels.

BACKGROUND OF THE INVENTION

In general, and in conventional manner, the sock is intended to be embedded in a bed of concrete and it comprises both an elastically deformable case that receives the tie which has a chamfered bottom edge, and a pad that lies beneath the tie on the bottom of said case. The sock imparts a degree of resilience to the track in the vertical and horizontal directions.

The sock is made of a resilient material which is generally constituted by a cellular rubber.

Nevertheless, that type of material can change in shape over time as a function of storage conditions.

In particular, when storage conditions (temperature, humidity, . . . ) are not favorable, the pad shrinks significantly.

Such shrinkage opens up a peripheral volume that remains empty between the tie and the side edges of the pad inside the case.

Unfortunately, while the concrete bed is being made for receiving the tie-carrying sock, the hydrostatic pressure from the still-liquid concrete is sufficient to deform the wall of the case, which then fills in the gap that exists inside the case between its own inside wall and the pad.

In this situation, the bottom outline of the tie rests on the deformed wall of the case and not on the pad.

This gives rise to a "point of stiffness", i.e. a rigid zone that constitutes an abutment and prevents the tie moving vertically.

This gives rise to a disturbance in the vibrational behavior of the track which can lead to the case and the tie being damaged.

OBJECTS AND SUMMARY OF THE INVENTION

An object of the present invention is to solve these technical problems in satisfactory manner.

According to the invention, this object is achieved by means of a sock for a tie of ballastless rail track that is to be held in a bed of concrete, the sock comprising firstly an elastically deformable case receiving said tie whose bottom edge is chamfered, and secondly a pad lying beneath the tie in the bottom of said case, wherein the bottom portion of said case includes, in its inside wall, recesses guaranteeing compression flexibility thereto even after said wall has been deformed under the effect of hydrostatic pressure from the concrete bed.

According to an advantageous characteristic, said recesses are formed over a height of the inside wall corresponding to the thickness of the pad plus the height of the chamfer of the tie.

According to another characteristic, said recesses are formed both in the side wall and in the bottom so as to extend beneath the edge of said pad.

According to yet another characteristic, between the recesses the inside wall includes stiffeners formed by projections or extra thickness serving to reinforce said wall.

Preferably, said stiffeners are formed in the bottom corners of said case over a height corresponding to the height of the pad.

In a first embodiment, said recesses are in the form of fluting.

In another embodiment, said recesses are in the form of cells.

The sock of the invention makes it possible to ensure that the ballastless track will operate properly both statically and dynamically even if the pad has changed shape.

In the event of the case deforming while the concrete bed is being cast, the tie nevertheless continues to be supported resiliently without any "point of stiffness" appearing.

The recesses formed in the inside wall of the case thus make it possible, under all circumstances in which the tie is being pushed down, to guarantee flexibility in compression.

BRIEF DESCRIPTION OF THE DRAWINGS

The invention will be better understood on reading the following description of the accompanying drawings, in which.

MORE DETAILED DESCRIPTION

Figure 1:
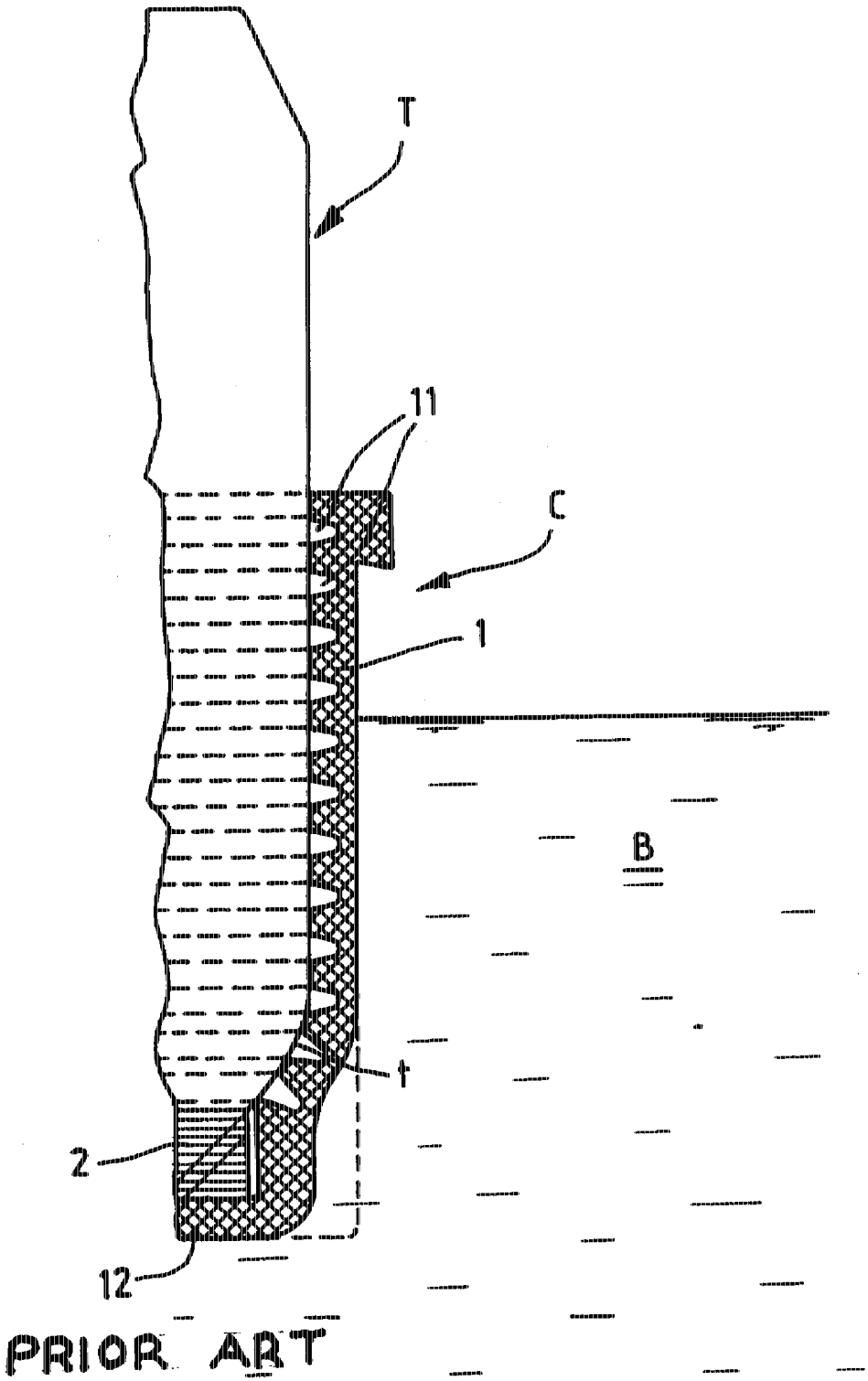
FIG. 1 is a cross-section of a conventional sock in the deformed state, together with its tie.

The sock shown in FIG. 1 is a conventional sock C for a tie T of ballastless track. The sock C is locked in place in a bed of concrete B.

The sock C comprises firstly an elastically deformable case 1 receiving the tie T, and secondly a pad 2 resting beneath the tie T on the bottom 12 of the case 1. The bottom outline of the tie T is chamfered at t. The internal side wall of the case 1 is provided with peripheral grooves 11 serving to provide both longitudinal and transverse resilience to the tie T and freedom for the tie to move vertically when rolling loads pass along the track.

Nevertheless, the pad 2 may be subject to shrinkage due to poor storage conditions in which case it will no longer completely fill the housing provided therefor in the bottom portion of the case 1.

The empty peripheral volume that then exists around the pad 1 is liable to be filled by the envelope 1 deforming under the effect of hydrostatic pressure from concrete in the liquid state when the bed B is cast.

This deformation gives rise to the corner zone of the side wall of the case 1 deforming so that it comes into bearing contact against the chamfer t of the tie T as shown by dash lines and solid lines in FIG. 1.

This deformation creates a rigid zone constituting an abutment against vertical displacement of the tie T.

Figure 2:
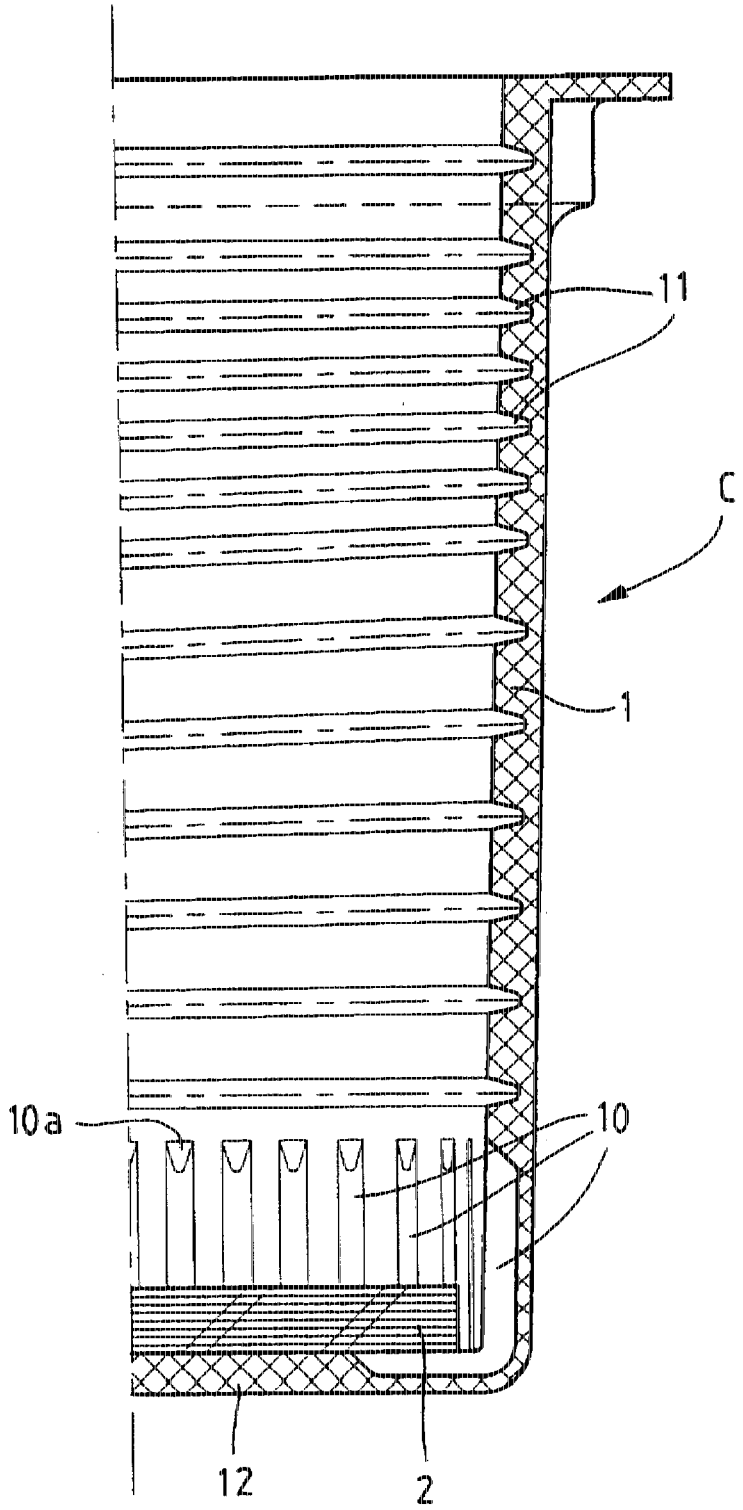
FIG. 2 is a cross-section of a first embodiment of a sock of the invention in the empty state, without any tie.

The sock C of the invention as shown in FIG. 2 in the empty state (i.e. without a tie) comprises a case 1 in which the bottom portion is provided with recesses 10 in its inside wall.

Figure 3:
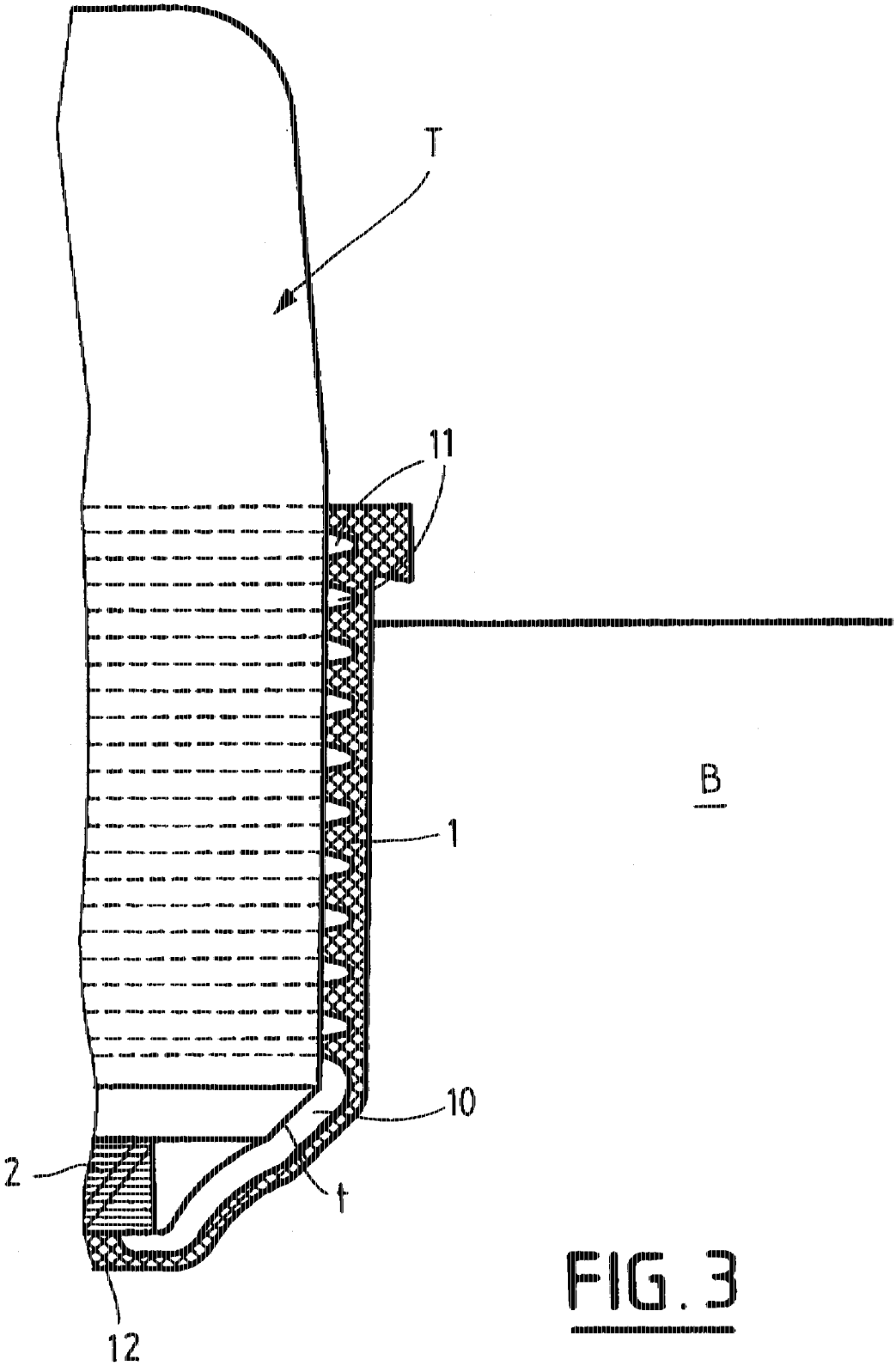
FIG. 3 is a cross-section of the FIG. 2 sock together with its tie, after it has been deformed and locked in place in the concrete bed.

The recesses 10 are to ensure that the case 1 continues to be flexible in compression even after its wall has been deformed by hydrostatic pressure in the concrete. In FIGS. 2 and 3, the recesses 10 are implemented in the form of vertical fluting of height equal to at least the thickness of the pad 2 plus the thickness of the chamfer t on the tie T. In this way, abutment between the tie on the pad 2 and the case 1 takes place in uniformly distributed manner, thereby imparting resilient support to the tie. In another embodiment (not shown) the recesses are made in the form of cells.

The fluting 10 may optionally extend over the inside wall of the bottom 12 of the case 1 to beneath the peripheral margin of the pad 2.

The ends 10*a* of the fluting are preferably chamfered so as to facilitate unmolding thereof during manufacture of the sock C.

Each portion of fluting corresponds to weakening of the wall of the case 1 and thus to a reduction in its intrinsic stiffness or to an increase in its flexibility.

Figure 4:
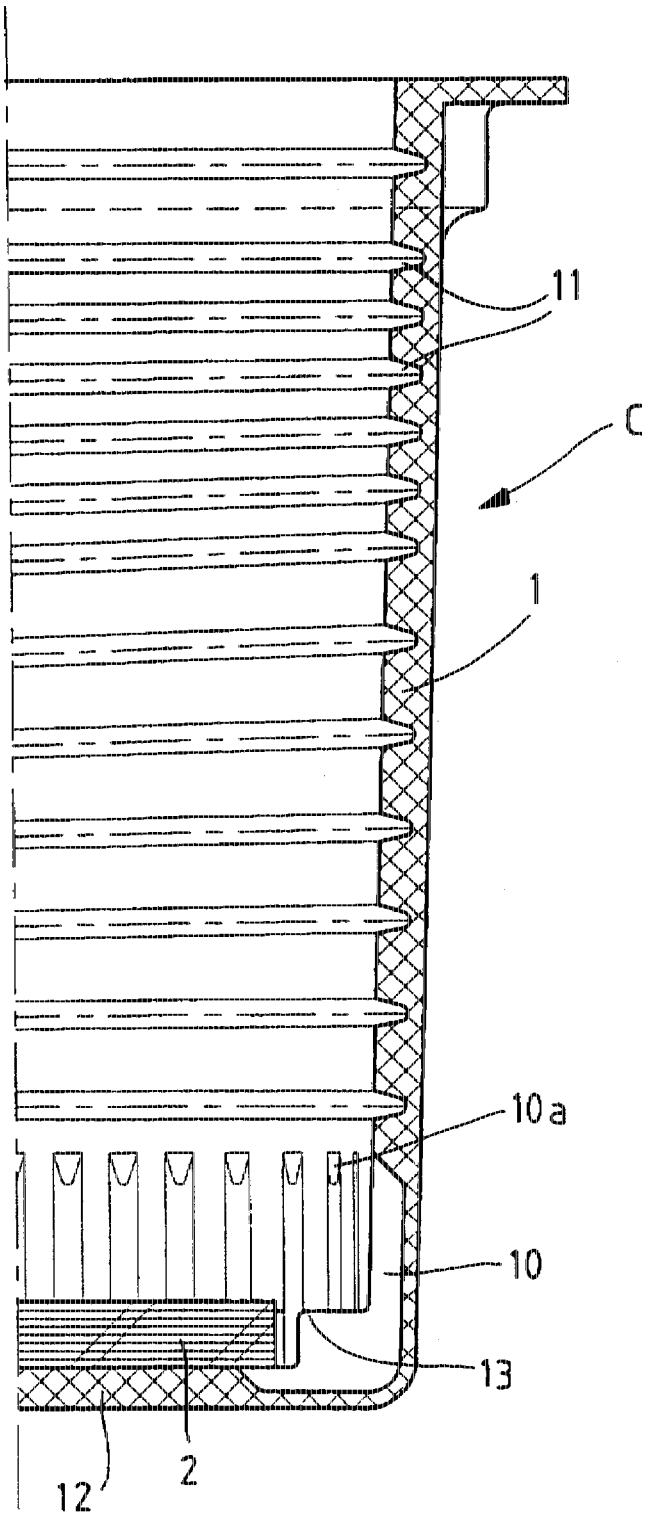
FIG. 4 is a cross-section view of a variant embodiment of the sock of the invention.

The sock shown in FIG. 4 corresponds to a variant embodiment in which the recesses 10, in this case formed as fluting, are separated by stiffeners 13 constituted by projections or regions of greater thickness serving to reinforce the wall of the case 1.

The projections 13 project into the inside of the bottom corner of the case 1 and enable the corner region connecting together the side wall and the bottom 12 better to withstand deformation from external hydrostatic pressure. The height of the projections 13 corresponds substantially to the height of the pad 2 while it is in the free state, such that the bottom face of the tie T rests both on the pad and, at its periphery, on the top faces of the projections 13.

Under such circumstances, the pad 2 is made initially with dimensions that are significantly shorter than in the other embodiments so that when it is in the free state and in the absence of any deformation, a small amount of clearance remains between the periphery of the pad 2 and the vertical faces of the projections 13.

I claim:

1. A sock for a tie of ballastless rail track that is to be held in a bed of concrete, the sock comprising firstly an elastically deformable case with an inside wall and a bottom, said case receiving a tie with a chamfered bottom edge of predetermined height, and secondly a pad of a predetermined thickness lying beneath the tie at the bottom of said case, wherein the case adjacent its bottom includes, in its inside wall, recesses guaranteeing compression flexibility thereto even after said wall has been deformed under the effect of hydrostatic pressure from a concrete bed, said recesses being formed over a height of the inside wall corresponding to the thickness of the pad plus the height of the chamfer of the tie.

2. A sock according to claim 1, wherein said recesses are formed both in the inside wall and in the bottom so as to extend beneath the edge of said pad.

3. A sock according to claim 1, wherein, between the recesses, the inside wall includes stiffeners formed by projections or extra thickness serving to reinforce said wall.

4. A sock according to claim 1, wherein said recesses are in the form of fluting.

5. A sock according to claim 1, wherein said recesses are in the form of cells.

6. A sock for a tie of ballastless rail track that is to be held in a bed of concrete, the sock comprising firstly an elastically deformable case with an inside wall and a bottom, said case receiving a tie with a chamfered bottom edge of predetermined height, and secondly a pad of a predetermined thickness lying beneath the tie at the bottom of said case, wherein the case adjacent its bottom includes, in its inside wall, recesses guaranteeing compression flexibility thereto even after said wall has been deformed under the effect of hydrostatic pressure from a concrete bed, the inside wall, between the recesses, including stiffeners formed by projections or extra thickness serving to reinforce said wall, said stiffeners being formed adjacent the bottom of said case over a height corresponding to the thickness of the pad.

7. A sock for a tie of ballastless rail track that is to be held in a bed of concrete, the sock comprising firstly an elastically deformable case with an inside wall and a bottom, said case receiving a tie with a chamfered bottom edge of predetermined height, and secondly a pad of a predetermined thickness lying beneath the tie at the bottom of said case, wherein the case adjacent its bottom includes, in its inside wall, recesses guaranteeing compression flexibility thereto even after said wall has been deformed under the effect of hydrostatic pressure from a concrete bed, said recesses being in the form of fluting and wherein the fluting have chamfered ends.

* * * * *

UNITED STATES PATENT AND TRADEMARK OFFICE

CERTIFICATE OF CORRECTION

PATENT NO. : 5,713,517

DATED : February 3, 1998

INVENTOR(S) : Claude LOISON

It is certified that error appears in the above-indentified patent and that said Letters Patent is hereby corrected as shown below:

Column 4, line 8, delete "the edge of".

Signed and Sealed this

Fourteenth Day of April, 1998

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,713,517

DATED : February 3, 1998

INVENTOR(S) : Claude LOISON

It is certified that error appears in the above-indentified patent and that said Letters Patent is hereby corrected as shown below:

Title page, column 1, section [30] Foreign Application Priority Data should read as follows:

--Nov. 9, 1995 [FR] France..... 95 13260--

Signed and Sealed this

Sixteenth Day of June, 1998

*Attest:*

*Attesting Officer*

BRUCE LEHMAN

*Commissioner of Patents and Trademarks*